US012565246B2

(12) United States Patent
Rasekhi et al.

(10) Patent No.: US 12,565,246 B2
(45) Date of Patent: Mar. 3, 2026

(54) BOARDING SYSTEM, HAVING SLIDING FOOTSTEP AND ACTIVE SEAL

(71) Applicant: BODE-DIE TÜR GMBH, Kassel (DE)

(72) Inventors: Abbas Rasekhi, Kassel (DE); Christoph Theis, Bad Wildungen (DE)

(73) Assignee: BODE—DIE TÜR GMBH, Kassel (DE)

( * ) Notice: Subject to any disclaimer, the term of this patent is extended or adjusted under 35 U.S.C. 154(b) by 482 days.

(21) Appl. No.: 18/263,060

(22) PCT Filed: Jan. 27, 2022

(86) PCT No.: PCT/EP2022/051918
§ 371 (c)(1),
(2) Date: Jul. 26, 2023

(87) PCT Pub. No.: WO2022/167321
PCT Pub. Date: Aug. 11, 2022

(65) Prior Publication Data

US 2024/0083470 A1 Mar. 14, 2024

(30) Foreign Application Priority Data

Feb. 2, 2021 (DE) ..... 202021100518.1

(51) Int. Cl.
*B61D 23/02* (2006.01)

(52) U.S. Cl.
CPC ..... *B61D 23/02* (2013.01)

(58) Field of Classification Search
CPC ..... B60R 3/02; B61D 23/025; B61D 23/00; B61D 23/02
See application file for complete search history.

(56) References Cited

U.S. PATENT DOCUMENTS 1,260,754 A * 3/1918 Cochran ..... B61D 23/02 105/449
2,226,717 A * 12/1940 Haessler ..... B61D 23/02 105/437

(Continued)

FOREIGN PATENT DOCUMENTS

CN 110281965 A * 9/2019 ..... B61D 19/023
CN 112498385 A * 3/2021 ..... B61D 17/00

(Continued)

OTHER PUBLICATIONS

International Search Report for International Application No. PCT/EP2022/051918, dated May 2, 2022, 2 pages.

(Continued)

*Primary Examiner* — Paul N Dickson
*Assistant Examiner* — Maxwell L Meshaka
(74) *Attorney, Agent, or Firm* — CANTOR COLBURN LLP

(57) ABSTRACT

A boarding system for a passenger transport vehicle, in particular a rail vehicle includes a door portal via which a floor of a passenger space of the vehicle is accessible, a door leaf with which a predominant area of a door opening is closed, a step with a step tread surface, which is arranged below the floor in the vertical direction and, in the horizontal direction, extends from the door opening to a vertical surface connecting the step tread surface and the floor, and an extendable sliding tread, which is arranged below the door leaf in the area of the door portal and which has a horizontally oriented tread surface and, at its end facing towards the door leaf, a vertically oriented front wall.

(Continued)

A movable sealing member is provided which, in the intermediate position of the sliding tread, forms a seal against an adjacent passive sealing surface.

10 Claims, 7 Drawing Sheets

(56) References Cited

U.S. PATENT DOCUMENTS

| | | | | | |
|---|---|---|---|---|---|
| 3,408,959 | A * | 11/1968 | Cripe | B61D 23/02 | 280/166 |
| 3,913,497 | A * | 10/1975 | Maroshick | B61D 23/02 | 280/166 |
| 3,957,284 | A * | 5/1976 | Wright | B61D 23/02 | 105/445 |
| 6,263,804 | B1 * | 7/2001 | Rizk | B61D 23/02 | 105/430 |
| 6,443,072 | B2 * | 9/2002 | Rizk | B61D 23/02 | 105/430 |
| 9,168,190 | B2 * | 10/2015 | Rasekhi | B60R 3/02 | |
| 10,106,069 | B2 * | 10/2018 | Rasekhi | B61D 23/025 | |
| 12,162,519 | B2 * | 12/2024 | Theis | E01F 1/00 | |
| 12,258,051 | B2 * | 3/2025 | Guggenbichler | B61D 19/008 | |
| 2001/0025585 | A1 * | 10/2001 | Rizk | B61D 23/02 | 105/430 |
| 2003/0056686 | A1 * | 3/2003 | Morlok | B61D 1/06 | 105/443 |
| 2014/0147237 | A1 * | 5/2014 | Rasekhi | B60R 3/02 | 414/537 |
| 2017/0327022 | A1 * | 11/2017 | Rasekhi | E01D 15/00 | |
| 2021/0331715 | A1 * | 10/2021 | Theis | B61D 23/025 | |
| 2021/0380147 | A1 * | 12/2021 | Guggenbichler | B61D 19/008 | |
| 2023/0039798 | A1 * | 2/2023 | Theis | E05D 15/1007 | |
| 2024/0083470 | A1 * | 3/2024 | Rasekhi | B61D 23/00 | |
| 2024/0253673 | A1 * | 8/2024 | Theis | B61D 23/025 | |
| 2024/0308428 | A1 * | 9/2024 | Cimmino | B60R 3/02 | |
| 2025/0114256 | A1 * | 4/2025 | Arend | B61D 23/025 | |

FOREIGN PATENT DOCUMENTS

| | | | | | |
|---|---|---|---|---|---|
| CN | 112498385 | B * | 7/2025 | B60L 13/04 | |
| DE | 202008003774 | U1 | 8/2009 | | |
| DE | 102008057536 | A1 | 5/2010 | | |
| DE | 102013200071 | A1 | 7/2014 | | |
| DE | 102014208288 | A1 | 11/2015 | | |
| DE | 102016125785 | A1 | 6/2018 | | |
| DE | 202018106995 | U1 * | 3/2020 | B61D 23/02 | |
| EP | 2103469 | A1 * | 9/2009 | B60J 10/248 | |
| EP | 2845768 | A2 * | 3/2015 | E06C 5/04 | |
| EP | 3213973 | A1 | 9/2017 | | |
| KR | 102045457 | B1 * | 11/2019 | B60R 3/02 | |

OTHER PUBLICATIONS

Written Opinion for International Application No. PCT/EP2022/051918, dated May 2, 2022, 3 pages.

* cited by examiner

BOARDING SYSTEM, HAVING SLIDING FOOTSTEP AND ACTIVE SEAL

CROSS-REFERENCE TO RELATED APPLICATIONS

This application is a 35 U.S.C. § 371 National Stage patent application of PCT/EP2022/051918, filed on 27 Jan. 2022, which claims the benefit of German patent application 202021100518.1, filed on 2 Feb. 2021, the disclosures of which are incorporated herein by reference in their entirety.

TECHNICAL FIELD

The present application relates to a boarding system for a passenger transport vehicle, in particular a rail vehicle, comprising:

- a door portal via which a floor of a passenger space of the vehicle is accessible,
- a door leaf with which a predominant area of a door opening can be closed,
- a step with a step tread surface, which is arranged below the floor in the vertical direction and, in the horizontal direction, extends from the door opening to a vertical surface connecting the step tread surface and the floor.

BACKGROUND

Boarding systems with door portals, door leaves and a step are known in principle from the prior art. In such boarding systems, a door leaf closes a door opening and, in the process, forms a peripheral seal against the door frame.

In local public transport rail vehicles, there is often the situation of a gap remaining between the vehicle or the door opening and a platform, which has to be bridged. Such a bridging is usually obtained by means of a walk-on sliding tread, which extends from the door portal in the direction towards the platform and bridges the gap in the extended state.

If no sliding tread is provided, the lower seal of door leaves is usually formed against a tread strip in the door portion, which constitutes a fixed sealing surface. The latter may be arranged parallel to the door leaf or also obliquely relative thereto, and in the process always constitutes a static or unmovable counter-bearing. When retracting, sliding treads generally seal by means of a rubber seal, which is attached to the movable sliding tread itself. This seal is most frequently provided at the underside and laterally of a front surface of the sliding tread, so that a lid/flange sealing situation is brought about in the retracted state. Moreover, it is possible to seal with brushes or rubbers at the upper side of the front surface or the tread surface of the sliding tread. Sliding treads which execute a vertical movement when retracting are also known, whereby the upper tread surface comes to rest against a sealing surface.

A combination of a step in the area of the door portal with an extendable sliding tread is not known so far due to the sealing issues.

SUMMARY

Therefore, the present disclosure creates a boarding system that includes a step and an extendable sliding tread but is nevertheless sufficiently sealed from the outside. In this case, the seal is supposed to be subject to only little wear and is permanently tight.

According to the disclosure, this is achieved by providing a boarding system having the features of the independent claim.

Accordingly, the boarding system is characterized by

- an extendable sliding tread, which is arranged below the door leaf in the area of the door portal and which has a horizontally oriented tread surface and, at its end facing towards the door leaf, a vertically oriented front wall, wherein

- the front wall reaches almost to the step tread surface,
- in a retracted end position of the sliding tread, the tread surface is completely underneath the floor,
- in an intermediate position of the sliding tread, the front wall is aligned with the closed door leaf,
- in an extended position of the sliding tread, the front wall is arranged outside the vehicle, wherein the boarding system has a movable sealing member which, in the intermediate position of the sliding tread, forms a seal against an adjacent passive sealing surface.

Thus, the sliding tread is positioned directly below the door leaf, so that the sealing member seals between the door leaf and the sliding tread when the door leaf is closed. In its intermediate position and in its extended position, the tread surface of the sliding tread is located at about the level of the floor of the passenger space. When the sliding tread is extended, passengers are thus able to enter the vehicle on approximately a single level. After the door leaf has been closed, the sliding tread is then either moved into the intermediate position and the door leaf is closed. At the same time as, or subsequent to, the closing process, the sealing member moves against an adjacent passive sealing surface, preferably against a lower edge of the door leaf, and thus seals the interior space.

A step with a step tread surface, which is exposed by retracting the sliding tread into its retracted position, is located below the sliding tread. In this state, it is possible to enter the vehicle via the step. This is necessary particularly if the platform is located below the floor of the passenger space.

The disclosure makes it possible that the door leaf does not have to seal against a tread strip but can use the sliding tread for this purpose. In its intermediate position, the sliding tread can seal against fixed elements of the door portal on the sides and at the bottom. In contrast, towards the top, i.e. in the direction of the lower edge of the door leaf, the sealing action is effected against the movable door leaf.

In the intermediate position, the front wall of the sliding tread closes the remaining area of the door opening, which approximately corresponds to the height of the step or the vertical surface of the latter.

The movable sealing member may be mounted so to be displaceable in the linear direction, so that it can be moved from a non-sealing position into a sealing position. Alternatively or additionally, it is possible to mount the sealing member such that is can be pivoted from the non-sealing position into the sealing position. It is also possible that the sealing member does not move as a whole, but that only parts move or change their shape. For example, the sealing member may be configured as a pneumatic sealing member that seals by means of a pressure increase and volume increase.

In principle, the movable sealing member may also be arranged at other sides of the sliding tread or the front surface. In addition to a seal in the direction towards the door leaf, a seal towards the sides or downwards against the door portal by means of a moved sealing member may be possible.

Of course, it is also possible that the sealing member is arranged on the door leaf. Preferably, it is then located on the lower edge of the door leaf and seals against the tread surface of the sliding tread from above.

Preferably, the sealing member may be arranged in a groove. Advantageously, it then protrudes from the grooves in its active position. In this case, the groove is configured and arranged such that it extends parallel to the opposite sealing surface in the closed position of the door leaf or in the intermediate position of the sliding tread.

In a particularly advantageous embodiment, the sealing member contacts, at least with a lateral end portion, a guide that causes a movement of the sealing member from the passive position into the active position and back. If the sealing member is arranged in the tread surface of the sliding tread, for example, the end portions of the sealing member may laterally protrude relative to the sliding tread, for example. Lateral guides are provided in the door portal, i.e. in the frame of the door opening, for example, which contact the end portions of the sealing member when the sliding tread is moved. The guides deflect the end portions from their otherwise linear movement, thus pushing the end portions, and thus the sealing member, upwards in the intermediate position of the sliding tread, for example. This may be accomplished by means of groove-like guides, for example, which have an arc in the direction towards the door leaf in the corresponding area of the intermediate position of the sliding tread. If the end portions run through this arc, the sealing member, accordingly, is automatically pivoted upwards or moved linearly upwards. Either both lateral end portions may contact corresponding guides, but it may also be sufficient to provide such a guide only on one side of the sliding tread.

As an alternative to triggering the sealing member by means of a guide, other systems may also be used. For example, the movement of the sealing member may also be triggered by a cable.

In a particularly preferred embodiment, the sealing member is configured and arranged such that, in the passive, non-sealing state, it does not protrude in the direction towards the walk-on tread surface of the sliding tread. Thus, a tripping hazard constituted by the sealing member is to be avoided. If the sealing member is arranged in a groove, for example, it is located completely within the groove in the passive state, or protrudes only laterally in order to contact guides via the end portions.

BRIEF DESCRIPTION OF THE DRAWINGS

The present disclosure is explained in more detail below with reference to exemplary embodiments and drawings. These exemplary embodiments are to be understood as examples and not as limiting, and are supposed to enable the person skilled in the art to carry out the disclosure. It is pointed out that the technical features, particularly technical means, mentioned in the exemplary embodiments may be used individually and also in combination by the person skilled in the art for developing the subject matters of the disclosure.

In the Figures.

DETAILED DESCRIPTION OF THE DRAWINGS

Figure 1:
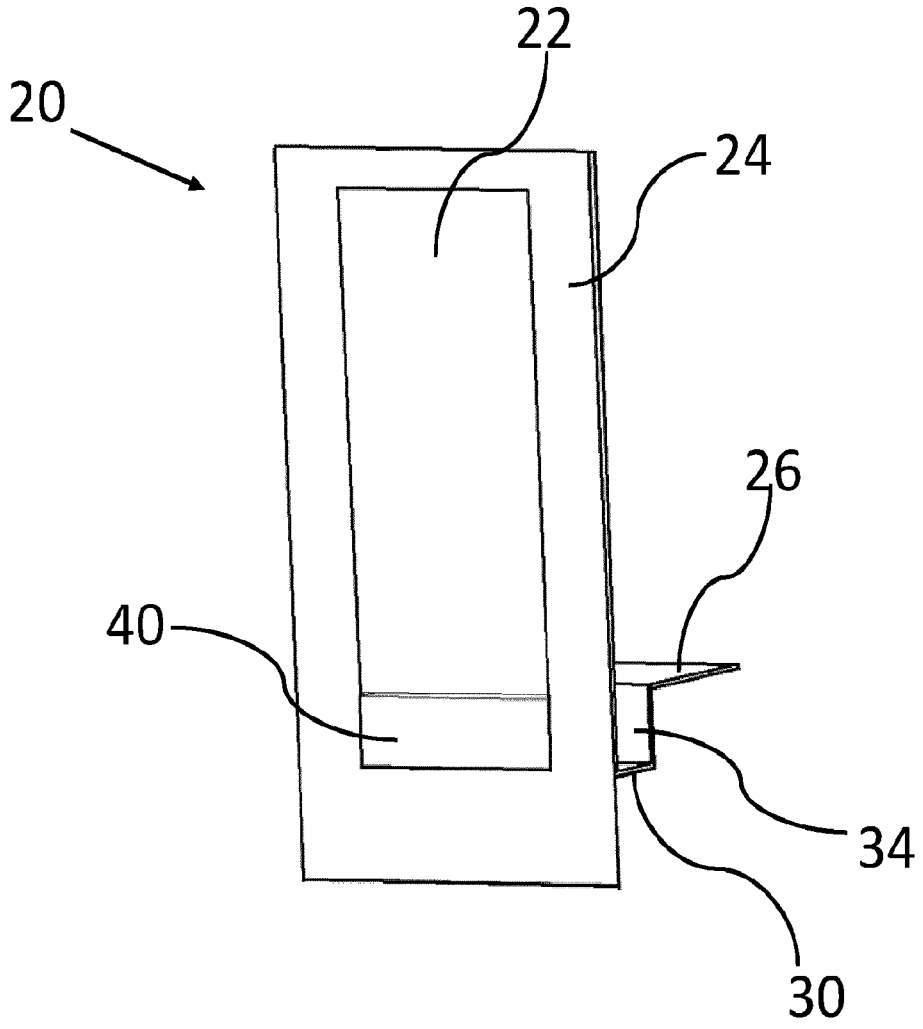
FIG. 1: shows a highly simplified schematic illustration of a boarding system or door system 20 in the closed state, wherein side walls of the vehicle are only shown partially.
Figure 2:
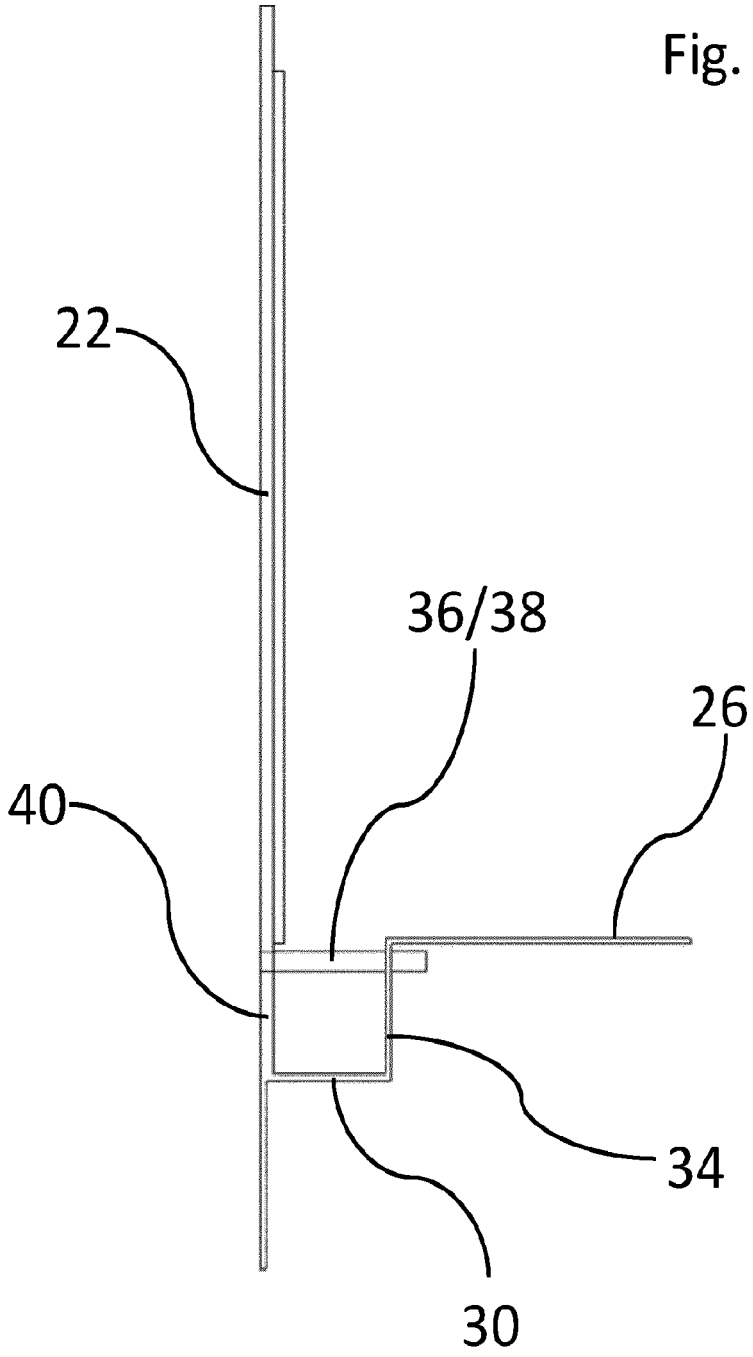
FIG. 2: shows a cross section of the door system 20 from FIG. 1, FIG. 3: shows an enlarged portion of the boarding system with the sliding tread 36 in the intermediate position and the sealing member 50 in the passive position.

FIG. 1 shows a boarding system 20 of a vehicle, preferably of a public transport vehicle, in a highly simplified schematic illustration. A door leaf 22 is surrounded by side walls 24 of the vehicle; the side walls 24 are only partially depicted. The door leaf 22, the side walls 24 and a door frame 62 (See FIG. 7) form a door portal of the boarding system 20. A floor 26 of the vehicle is accessible via the door portal.

Moreover, a step 28 is provided in the boarding system 20 or on the door portal, which is disposed below the floor 26 in the vertical direction. The step 28 has a step tread surface 30, which extends from the door opening 32 in the vertical direction to a vertical surface 34 of the step 28. The vertical surface 34 connects the step tread surface 30 with the floor 26. Passengers get into the vehicle from a platform, which is not shown and located below the floor 26, via the step 28.

The FIGS. 2 to 7, in particular, illustrate that the boarding system 20 further comprises an extendable and retractable sliding tread 36. The latter has a horizontally oriented tread surface 38 which transitions at its ends into a vertically oriented front wall 40. FIGS. 1 to 4 illustrate that the front wall 40 forms a partial area of an outer wall of the vehicle in an intermediate position of the sliding tread 36. In the intermediate position, the front wall 40 is aligned with the main extending surface of the door leaf 22 and closes an opening in the outer wall of the vehicle provided for the sliding tread 36 or the front wall 40.

Figure 6:
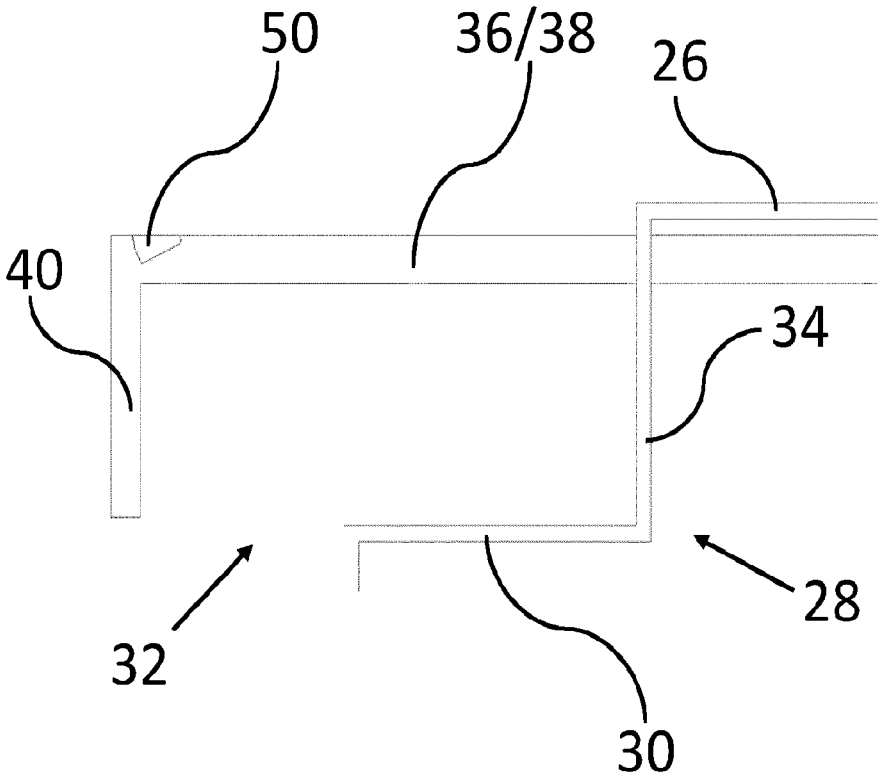
FIG. 6: shows an enlarged portion of the boarding system with the sliding tread 36 in the extended position.
Figure 7:
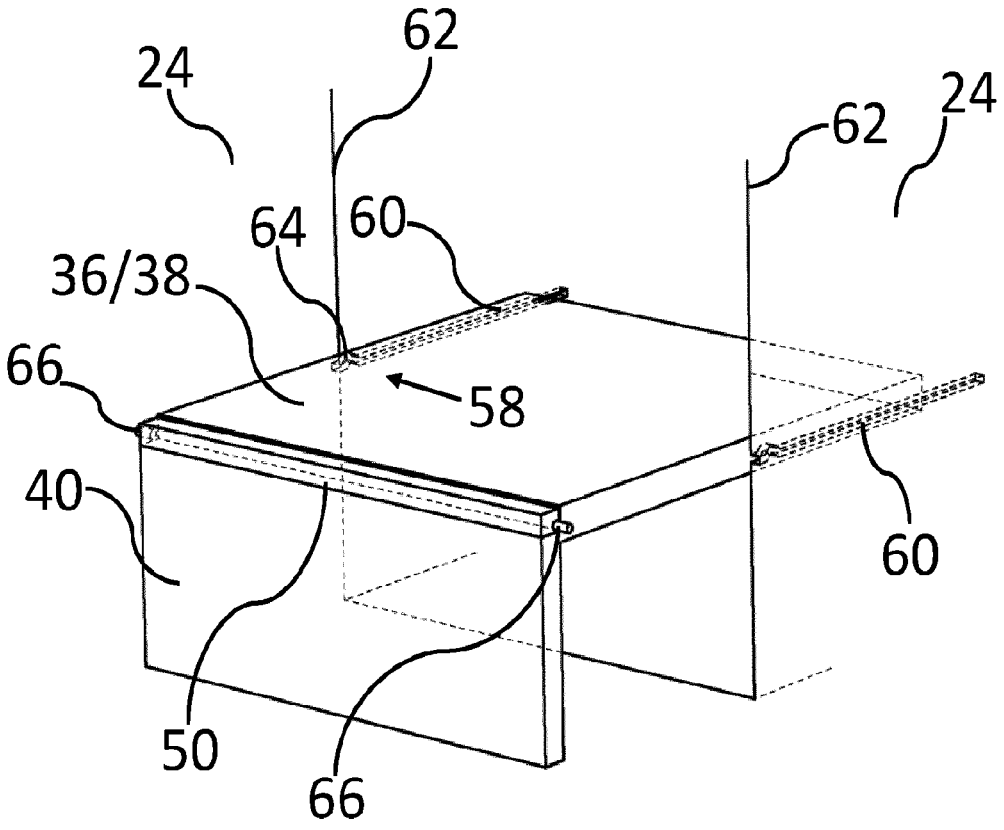
FIG. 7: shows a highly simplified schematic illustration of the sliding tread 36 and guides 58 in the door portal.

Moreover, the sliding tread 36 can be moved into an extended position in which it bridges a gap between a platform and the vehicle, for example. In this extended position, the front wall 40 is located outside the vehicle, which is depicted in FIGS. 6 and 7.

In a retracted position of the sliding tread 36, the tread surface 38 is located substantially below the floor 26. A corresponding opening for this purpose, into which the sliding tread 36 or the horizontally oriented tread surface 38 can be retracted, is provided underneath the floor 26. In the intermediate position and in the extended position, the sliding tread 36 covers the step 28; in the retracted position, it exposes the step 28 and thus the step tread surface 30.

Figure 3:
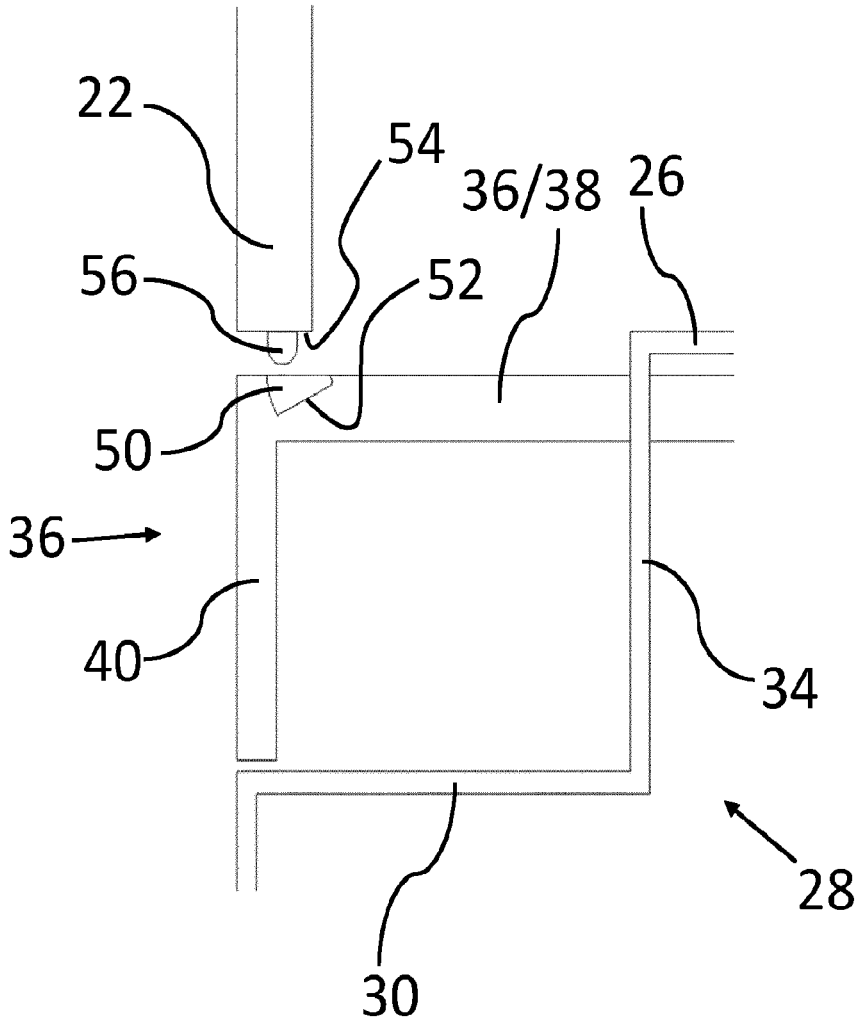

FIG. 3 further shows a sealing member 50 according to the disclosure in a non-sealing, passive position. In the depicted exemplary embodiment, the sealing member 50 of this position is arranged in a groove 52 recessed into the tread surface 38 of the sliding tread 36. The sealing member 50 preferably does not protrude relative to the tread surface 38 in order to prevent tripping over the sealing member 50.

Figure 4:
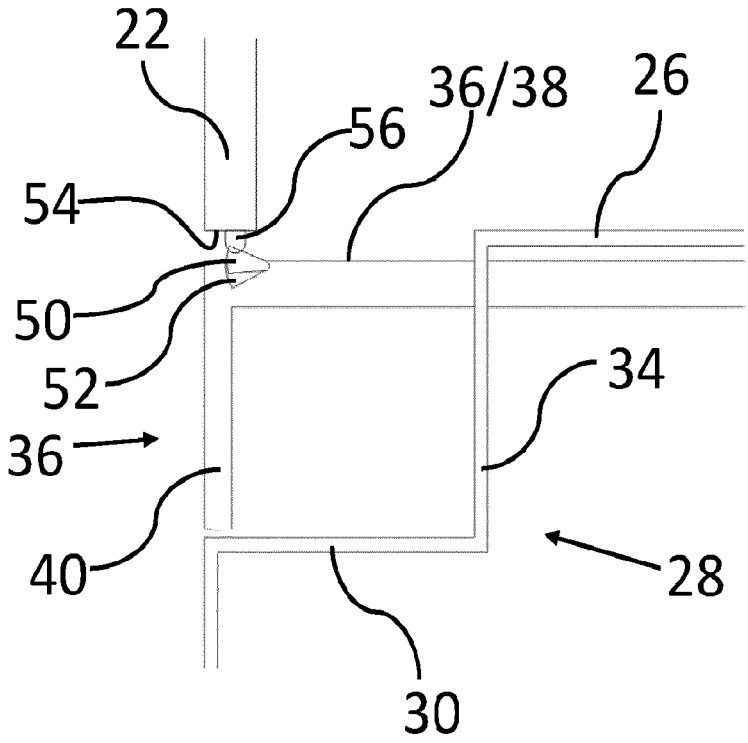
FIG. 4: shows an enlarged portion of the boarding system with the sliding tread 36 in the intermediate position and the sealing member 50 in the active position.
Figure 5:
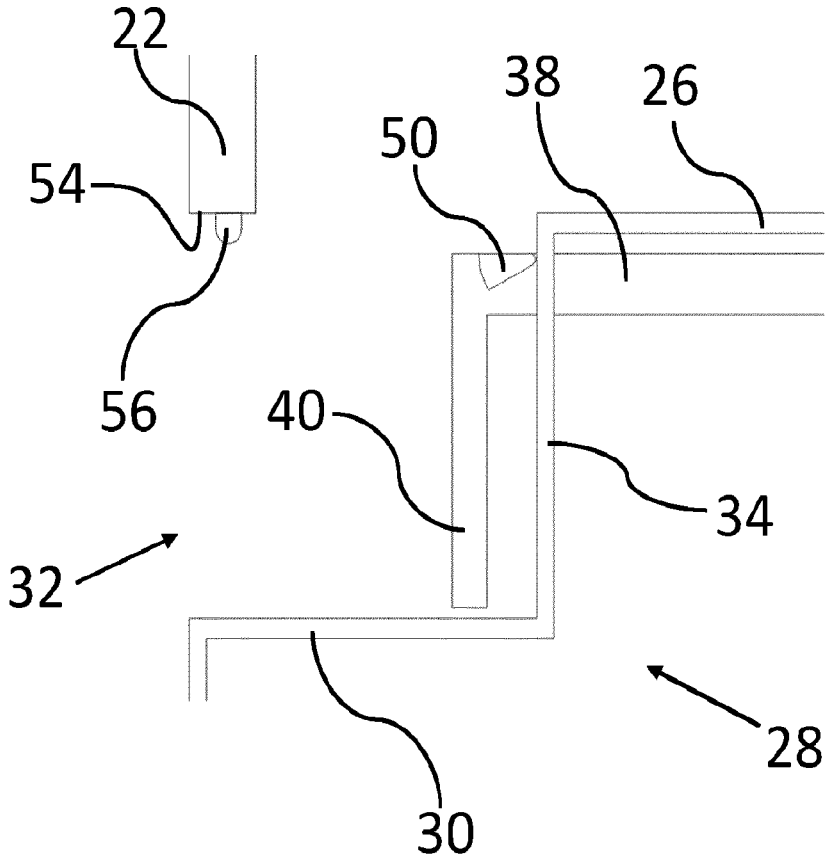
FIG. 5: shows an enlarged portion of the boarding system with the sliding tread 36 in the retracted position.

FIG. 4 illustrates that the sealing member 50 is pivotably mounted in the depicted exemplary embodiment and can be pivoted into an active, sealing position. In this position, the sealing member 50 pushes against a lower edge 54 of the door leaf 22 from below. In the depicted exemplary embodiment, the lower edge 54 has a second sealing member 56 against which the sealing member 50 seals.

By way of example, FIG. 7 shows a variant of the boarding system 20 in which the movement of the sealing member 50 is caused by a guide 58. The guide 58 has two guide grooves 60 that are respectively arranged laterally of the sliding tread 36 or of the tread surface 38 in a door frame 62 of the door opening 32. The guide grooves 60 extends substantially horizontally and parallel to the retracted tread surface 38 of the sliding tread 36. Arc portions 64 with upwardly oriented arcs are provided only in the front area, i.e. close to the door opening 32.

The sealing member 50 has end portions 66 protruding laterally relative to the tread surface 38. When the sliding tread 36 moves from the extended into its intermediate position, these end portions 66 move into the guide grooves 60. Due to the arc portion 64, the end portions 66 of the sealing member 50 are moved upwards, whereby the entire sealing member 50 is pressed against the lower edge 54 of the door leaf 22. In the further course of the movement of the sliding tread 36 into its retracted position, the end portions 66 are lowered again behind the arc portions 64.

The disclosure is not limited to the exemplary embodiment shown but also includes other embodiments. For example, only a single guide in the door frame 62 may suffice for moving the sealing member 50. Also, the guide 58 does not have to be formed by a guide groove 60; an element protruding relative to the door frame 62 is also conceivable.

The invention claimed is:

1. A boarding system for a passenger transport vehicle comprising:

a door portal via which a floor of a passenger space of the vehicle is accessible, a door leaf with which a predominant area of a door opening can be closed, a step with a step tread surface, which is arranged below the floor in the vertical direction and, in the horizontal direction, extends from the door opening to a vertical surface connecting the step tread surface and the floor, wherein an extendable sliding tread, which is arranged below the door leaf in the area of the door portal and which has a horizontally oriented tread surface and, at an end facing towards the door leaf, a vertically oriented front wall, wherein the front wall reaches almost to the step tread surface, in a retracted end position of the sliding tread, the tread surface is completely underneath the floor, in an intermediate position of the sliding tread, the front wall is aligned with the closed door leaf, in an extended position of the sliding tread, the front wall is arranged outside the vehicle, wherein the boarding system has a movable sealing member which, in the intermediate position of the sliding tread, forms a seal against an adjacent passive sealing surface.

2. The boarding system according to claim 1, wherein the sealing member is pivotable from a passive position into a sealing, active position and back.

3. The boarding system according to claim 1, wherein the sealing member is linearly movable from a passive position into a sealing, active position and back.

4. The boarding system according to claim 1, wherein the sealing member is arranged in a groove and protrudes in an active position from the groove.

5. The boarding system according to claim 1, wherein the sealing member contacts, at least with a lateral end portion, a guide that causes a movement of the sealing member from the passive position into the active position and back.

6. The boarding system according to claim 1, wherein the sealing member is arranged on the sliding tread and forms a seal against a sealing surface adjacent in a vertical plane.

7. The boarding system according to claim 6, wherein the groove is recessed into the tread surface and arranged such that the groove is arranged below the closed door leaf in the intermediate position of the sliding tread.

8. The boarding system according to claim 5, wherein one guide groove, respectively, which extends between the door opening and the vertical surface of the step, and in which the sealing member is guided in some portions on the moving path of the sliding tread and guided from the passive position into the active position and back, is arranged in vertical regions of a door frame.

9. A vehicle with a boarding system according to claim 1.

10. A method for sealing a boarding system with the features of claim 1, the method including the following steps:

closing the door leaf, moving the sliding tread into the intermediate position, and moving the sealing member from the passive position into the active position.

* * * * *